US010036103B2

(12) United States Patent
Chen et al.

(10) Patent No.: US 10,036,103 B2
(45) Date of Patent: Jul. 31, 2018

(54) PET INDUSTRIAL YARN MELT DIRECT SPINNING MANUFACTURING METHOD AND DEVICE THEREOF

(71) Applicant: Zhejiang Guxiandao Industrial Fiber Co., Ltd., Shaoxing (CN)

(72) Inventors: Wenxing Chen, Hangzhou (CN); Jianping Ma, Shaoxing (CN); Jianhui Wang, Shaoxing (CN); Zuhong Wang, Shaoxing (CN); Shuo Zhang, Yangzhou (CN); Xiong Liu, Yichang (CN); Lin Gao, Shaoxing (CN); Jiaoxue Shi, Shaoxing (CN)

(73) Assignee: ZHEJIANG GUXIANDAO POLYESTER DOPE DYEF YARN CO., LTD., Shaoxing, Zhejiang (CN)

( * ) Notice: Subject to any disclaimer, the term of this patent is extended or adjusted under 35 U.S.C. 154(b) by 337 days.

(21) Appl. No.: 14/772,773

(22) PCT Filed: Aug. 20, 2013

(86) PCT No.: PCT/CN2013/081811
§ 371 (c)(1),
(2) Date: Sep. 3, 2015

(87) PCT Pub. No.: WO2014/134904
PCT Pub. Date: Sep. 12, 2014

(65) Prior Publication Data

US 2016/0017516 A1 Jan. 21, 2016

(30) Foreign Application Priority Data

Mar. 8, 2013 (CN) ..... 2013 1 0074295

(51) Int. Cl.
*D01D 5/08* (2006.01)
*D01F 6/62* (2006.01)
(Continued)

(52) U.S. Cl.
CPC ..... *D01D 5/08* (2013.01); *D01D 1/02* (2013.01); *D01D 1/106* (2013.01); *D01D 5/092* (2013.01); *D01F 6/62* (2013.01); *D10B 2331/04* (2013.01)

(58) Field of Classification Search
CPC ..... D01F 6/62; D10B 2331/04; D01D 5/08; D01D 5/0023
See application file for complete search history.

(56) References Cited

FOREIGN PATENT DOCUMENTS

CN 101768788 A * 7/2010

* cited by examiner

*Primary Examiner* — Ryan Ochylski
(74) *Attorney, Agent, or Firm* — Leong C. Lei

(57) ABSTRACT

A PET industrial yarn melt direct spinning manufacturing method and a device thereof are disclosed. The device includes a polymerizer preparing base polyester melt, liquid tackifying reactors, and multi-head spinning units. The liquid tackifying reactors are connected with the polymerizer through split-flow pipelines respectively and after tackified by the tackifying reactors, the base polyester melt has its intrinsic viscosity reaching 0.90-1.10 dL/g. Each of the liquid tackifying reactors is connected with spinning units, and the spinning units are connected to the liquid tackifying reactors through melt pipelines. Each of the spinning units is provided with spinning boxes. The device solves the transportation problem of melt with high viscosity, combines both scale efficiency of the condensation production and market demand of multiple PET industrial yarns, and has the characteristic of integrating flexible production and intensive production.

9 Claims, 4 Drawing Sheets

(51) Int. Cl.

| | |
|---|---|
| ***D01D 1/02*** | (2006.01) |
| ***D01D 1/10*** | (2006.01) |
| ***D01D 5/092*** | (2006.01) |

PET INDUSTRIAL YARN MELT DIRECT SPINNING MANUFACTURING METHOD AND DEVICE THEREOF

BACKGROUND OF THE INVENTION

1. Technical Field

The present invention relates to a PET industrial yarn melt direct spinning manufacturing method and its device, specifically belonging to the technical field of PET industrial yarn manufacturing.

2. Description of Related Art

Currently, PET industrial yarn manufacturing implements a chip spinning process where PTA and EG are submitted to esterification, pre-polycondensation, final-polycondensation and quenching, and then cut into chips having intrinsic viscosity of 0.63~0.68 dL/g. The chips are further processed through solid-state polycondensation so as to produce high-viscosity chips of 0.85~1.05 dL/g. The high-viscosity chips are put into a screw extruder for melt spinning. Finally, after drawing performed by heat rollers of multiple stages, the yarn is wound for formation. As mentioned herein, solid-state polycondensation refers to a process where polyester chips are submitted to polycondensation at a temperature that is 30° C.~60° C. lower than the melting point thereof in a vacuum environment or in inert atmosphere such as that of nitrogen, so as to make the polyester's molecular weight continuously increase. The process of polycondensation can take as long as 20 some hours. The existing process for manufacturing PET industrial yarn through solid-state polycondensation chip spinning has problems such as long production cycles, large facility investment, and high energy consumption. Hence, liquid tackifying melt direct spinning manufacturing has been a desire in the industry.

Though there is technical breakthrough about liquid tackifying of polyester, two more technical problems have to be solved before large-scale melt direct spinning manufacturing of PET industrial yarn becomes possible. The first one is transportation of high-viscosity melt. PET industrial yarn requires melt having intrinsic viscosity of 0.90~1.05 dL/g or even higher. Such high-viscosity melt has great kinematic viscosity, so it is necessary to properly arrange the piping transportation of the melt from liquid tackifying reactors to spinning boxes in order to prevent excessive viscosity drop and inconsistency.

The second problem is how to make the manufacturing flexible enough for multiple PET industrial yarns. For manufacturers, it is important to make melt direct spinning PET industrial yarns in a way that provides scale merit of polyester manufacturing and satisfies the market demand for multiple PET industrial yarns.

SUMMARY OF THE INVENTION

For solving the transportation problem of melt with high viscosity in a way that provides scale merit of polyester manufacturing and satisfies the market demand for multiple PET industrial yarns, the present invention discloses a PET industrial yarn melt direct spinning manufacturing method that is flexible and intensive, and also discloses a device using this method. The technical schemes implemented are described particularly as follows.

A PET industrial yarn melt direct spinning manufacturing device comprises:

a polymerizer using a high-capacity continuous polymerizing apparatus and used for preparing base polyester melt that is polyethylene terephthalate (PET) melt having intrinsic viscosity of 0.63~0.68 dL/g;

2 to 10 liquid tackifying reactors each connected with the high-capacity continuous polymerizing apparatus through a split-flow pipeline, wherein the base polyester melt after tackified by the liquid tackifying reactor has the intrinsic viscosity reaching 0.90~1.10 dL/g;

multi-head spinning units in a number ranging between 2 and 10 connected with each said liquid tackifying reactor, wherein each of the spinning units is connected with the corresponding liquid tackifying reactor through a melt pipeline and equipped with 2 to 4 spinning boxes.

The device further has the following configuration.

The high-capacity continuous polymerizing apparatus refers to a polyester reactor that has single-line capacity high enough to continuously supply material for multiple liquid tackifying reactors for esterification and polycondensation.

The liquid tackifying reactor is a vertical reactor with capacity of 30~120 ton/day.

The spinning units are located below the liquid tackifying reactor and evenly distributed to center around the liquid tackifying reactor.

The spinning units are evenly distributed around a discharge gate of the liquid tackifying reactor, and all the melt pipelines between the spinning boxes and the discharge gate of the liquid tackifying reactor have an identical length of transportation.

The melt pipeline between the spinning unit and a discharge gate of the liquid tackifying reactor has a length of transportation not exceeding 15 m and has a diameter of 25~100 mm.

The spinning units and the liquid tackifying reactor are arranged into a "linear", "asteroidal" or "symmetrically rectangular" pattern.

A PET industrial yarn melt direct spinning manufacturing method comprises the following steps:

(1) preparing base polyester melt: performing esterification and melt polycondensation on terephthalic acid and ethylene glycol in a high-capacity continuous polymerizing apparatus, so as to produce PET (polyethylene terephthalate) base polyester melt having intrinsic viscosity of 0.63~0.68 dL/g, wherein parameters used include:

molar ratio between ethylene glycol and terephthalic acid of 1~1.3; for esterification, temperature of 250~265° C., pressure of 0.12~0.18 Mpa, and time 3~5 hours; for pre-polycondensation, temperature of 265~275° C., pressure of 2500~3000 Pa, and time of 1~1.5 hours; and for polycondensation, temperature of 275~295° C., pressure of 50~150 Pa, and time of 1.5~2.5 hours;

(2) liquid tackifying: transporting the prepared base polyester melt to liquid tackifying reactors through split-flow pipelines respectively for polycondensation, so as to produce high-viscosity polyester melt having intrinsic viscosity of 0.90~1.10 dL/g, wherein:

the liquid tackifying reactor is a vertical reactor, and parameters used for liquid tackifying include: temperature of 270~285° C., pressure of 50~130 Pa, time of 40~90 min, so that the tackified intrinsic viscosity reaches 0.90~1.1 dL/g, melt hue (b value) smaller than 4, and terminal carboxyl group content smaller than 30 mol/t;

(3) multi-head spinning: transporting the tackified high viscosity polyester melt to the spinning units through the melt pipelines respectively for multi-head spinning that is intensive spinning with 16~24 heads, and submitting the high viscosity polyester melt to a process of metering using a metering pump, filtering, spinning at spinnerets, quenching through chimneys, clustering and oiling, drawing and setting, and interlacing and winding formation, thereby completing spinning.

The method further has the following limitation.

The base polyester melt has intrinsic viscosity of 0.63~0.68 dL/g, with deviation less than ±0.005 dL/g, and has terminal carboxyl group content smaller than 30 mol/t.

The high-viscosity polyester melt has intrinsic viscosity reaching 0.90~1.1 dL/g, with melt hue (b value) smaller than 4 and terminal carboxyl group content smaller than 30 mol/t.

For transporting the high-viscosity polyester melt to the spinning boxes, the pipeline is no longer than 15 m, with diameter of 25~100 mm, temperature of 290~298° C., pressure of 25~30 MPa, shear rate of 10~18 m/s, retention time no longer than 8.0 min, and viscosity drop within 0.04~0.08 dL/g.

For the multi-head spinning, each said spinning unit spins 16~24 strands of yarn, namely each said spinning unit having 2 spinning boxes, and each said spinning box having 4~6 spinning members. The spinning member is of a twin-cavity cup type and has two melt passages. Two melting cavities of the spinning member each have an independent melt-filter, and two streams of the melt for the two heads share a common spinneret that has a split structure. Each said spinning member spins two strands of yarn with spinning temperature of 290~305° C., total denier count of each spinning position up to 20040 dtex, total draw ratio of 5.6~6.2%, oil pick-up percentage of 0.4~1.05%. For satisfying the need for multi-head spinning with small pitch and high capacity, said winding is performed using a parallel twin take-up machine running with winding speed of 2600~3300 m/min.

The present invention has the following benefits:

The present invention adopts a flexible, one-head-multi-reactor-multi-tail manufacturing line and intensive melt direct spinning multi-head spinning.

1. Flexible, one-head-multi-reactor-multi-tail manufacturing line: a large-scale continuous polymerizing apparatus is used to prepare base melt for benefiting from its efficient energy use and material use and consistent melt quality due to mass manufacturing. The liquid tackifying reactor has manufacturing capacity of a proper range of 30~120 ton/day. A polymerizing apparatus is downstream connected with 2 or more liquid tackifying reactors. Each of the liquid tackifying reactors supplies material to 2~10 spinning units. Each of the spinning units is equipped with 2~4 spinning boxes for spinning. Such configuration provides the benefits of batch polycondensation and is flexible enough to adapt to multiple PET industrial yarns as the market demands. Functional materials can be in-site added into the high-viscosity melt pipeline upstream the spinning system so as to produce various functional PET industrial yarns.

2. Intensive melt direct spinning multi-head spinning since the liquid tackifying reactors have proper manufacturing capability, and the spinning process involves intensive spinning with 16~24 heads, the spinning system following each of the liquid tackifying reactor can have a compact layout where the length of the high-viscosity melt pipeline is limited to 15 m. This compact layout when working with reasonable piping parameter and transportation conditions helps to minimize the viscosity drop. The present invention is highly adaptive to market demand of various PET industrial yarns, and significantly increase spinning capacity. It also helps to significantly reduce investment per unit capacity and energy consumption during manufacturing.

The invention as well as a preferred mode of use, further objectives and advantages thereof will be best understood by reference to the following detailed description of illustrative embodiments when read in conjunction with the accompanying drawings.

BRIEF DESCRIPTION OF THE DRAWINGS

in FIG. 2-FIG. 4: an elliptic figure denoting a liquid tackifying reactor 20, an arrow denoting a melt pipeline 50, a rectangular figure denoting a spinning unit 30, and a rounded rectangle denoting a spinning box 60.

DETAILED DESCRIPTION OF THE INVENTION

Figure 1:
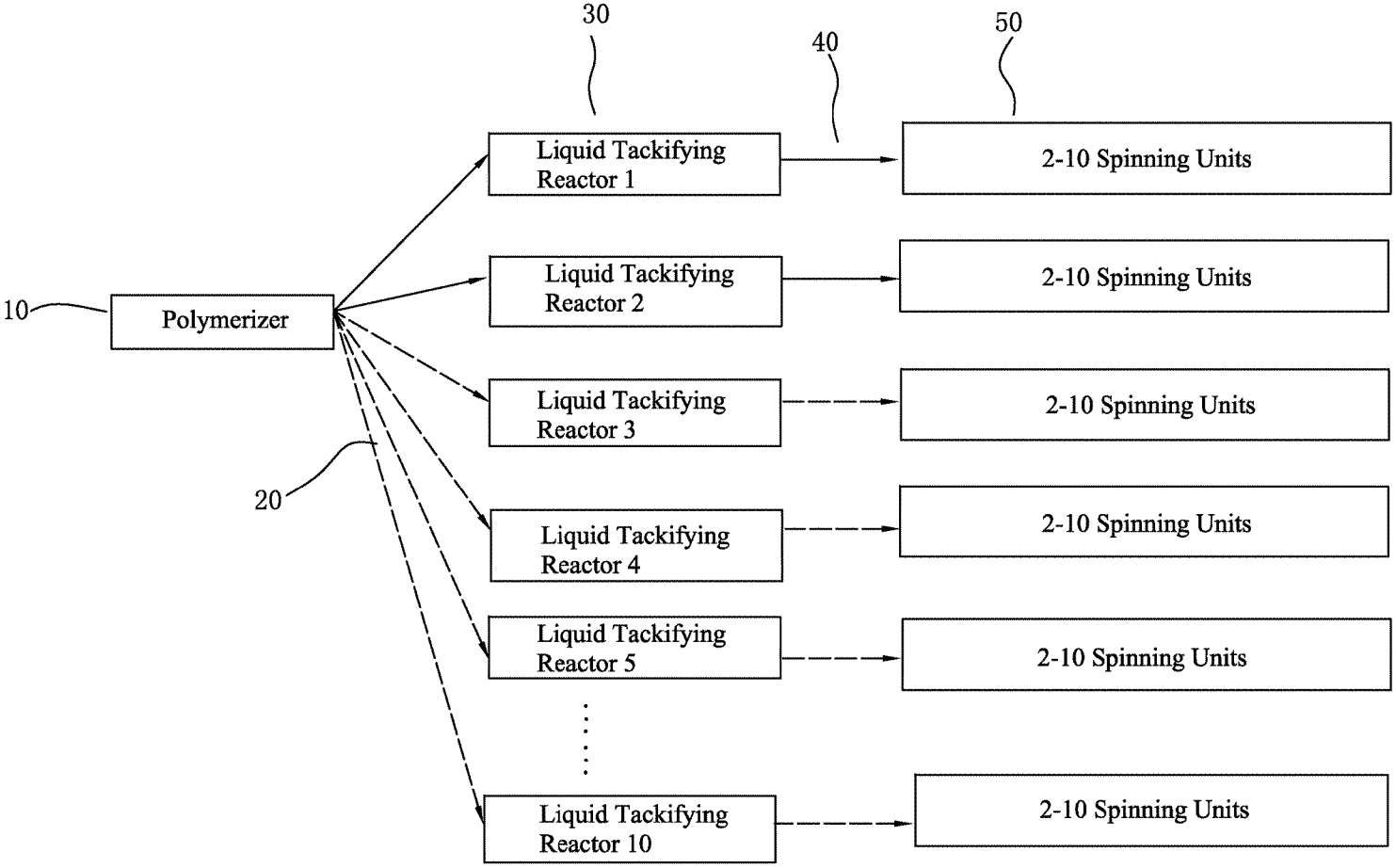
FIG. 1 is a schematic diagram illustrating a flexible manufacturing method according to the present invention involving melt polymerization, liquid tackifying, and melt direct spinning.

Referring to FIG. 1 through FIG. 4, according to the present invention, a PET industrial yarn melt direct spinning manufacturing device comprises a polymerizer 10, liquid tackifying reactors 20 and spinning units 30.

The polymerizer 10 uses a high-capacity continuous polymerizing apparatus and is used for preparing base polyester melt that is polyethylene terephthalate (PET) melt having intrinsic viscosity of 0.63~0.68 dL/g.

Two to ten liquid tackifying reactors 20 are each connected with one said high-capacity continuous polymerizing apparatus through a split-flow pipeline 40. The base polyester melt after tackified by the liquid tackifying reactor 20 has the intrinsic viscosity reaching 0.90~1.10 dL/g. The liquid tackifying reactor is preferably a vertical reactor having capacity of 30 to 120 ton/day.

Two to ten multi-head spinning units 30 are connected with each said liquid tackifying reactor 20. The spinning unit 30 is connected with the corresponding liquid tackifying reactor 20 through a melt pipeline 50 and equipped with 2 to 4 spinning boxes 60.

For achieving high efficiency of melt transportation and providing flexible and intensive production, the spinning units 30 are located below the liquid tackifying reactor 20 and evenly distributed to center around the liquid tackifying reactor 20. Particularly, the spinning units are evenly distributed around a discharge gate of the liquid tackifying reactor, and all the melt pipelines between the spinning boxes and the discharge gate of the liquid tackifying reactor have an identical length of transportation.

As proven by experiments, the best transportation efficiency is achieved when the length of the melt pipeline between the spinning unit and the discharge gate of the liquid tackifying reactor is not exceeding 15 m and the diameter of the melt pipeline ranges between 25 and 100 mm. Under these conditions, the melt transported can maintain desirable viscosity and consistency and the transportation speed is good.

Figure 2:
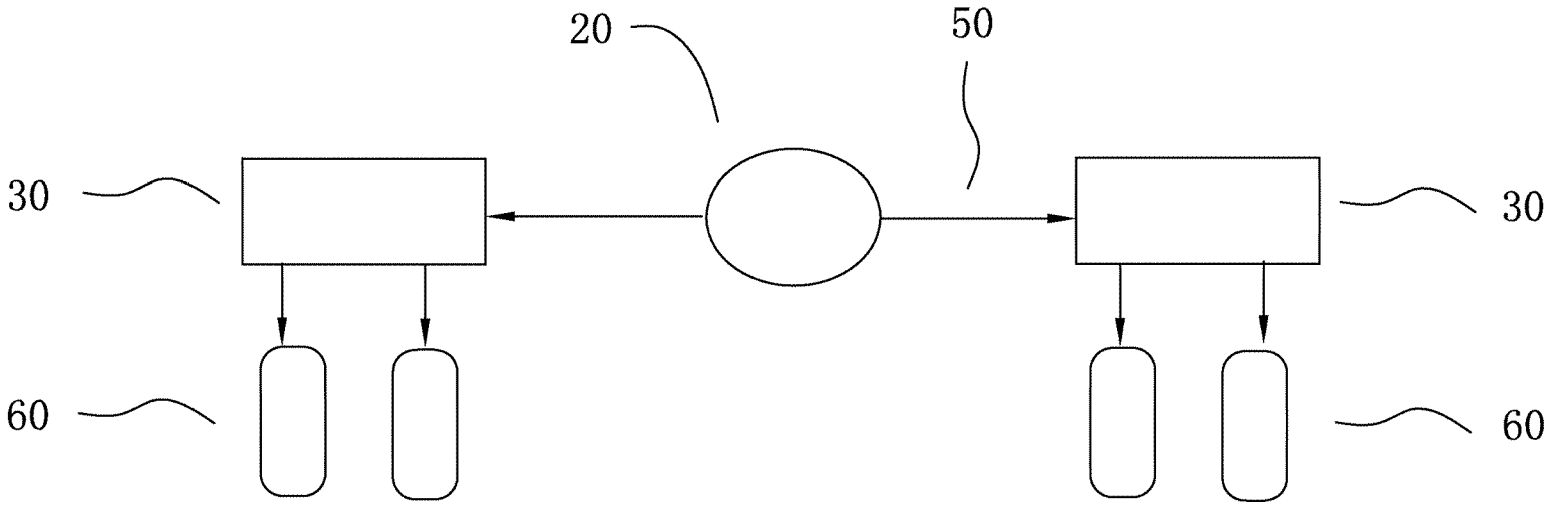
FIG. 2 according to one embodiment of the present invention shows one arrangement of melt pipelines and spinning units for a device composed of one liquid tackifying reactor and two spinning units.
Figure 3:
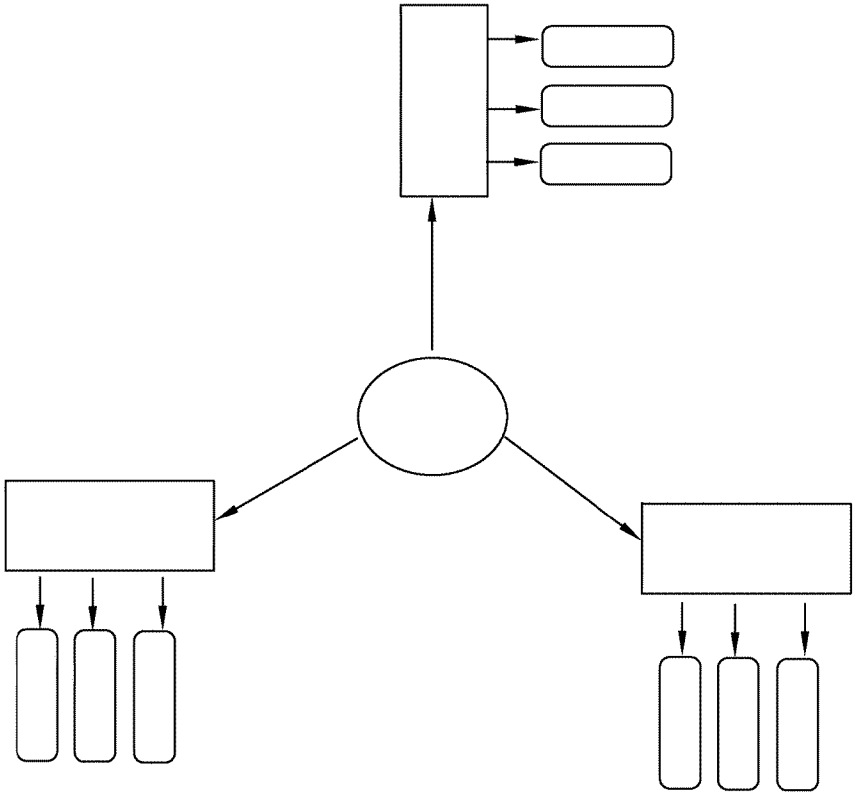
FIG. 3 according to one embodiment of the present invention shows one arrangement of melt pipelines and spinning units for a device composed of one liquid tackifying reactor and three spinning units.
Figure 4:
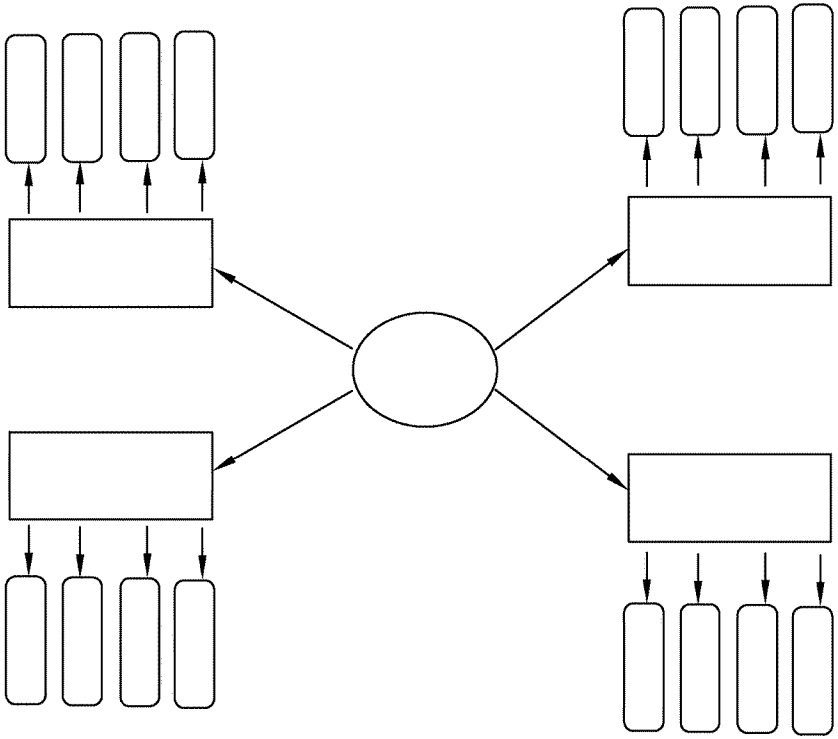
FIG. 4 according to one embodiment of the present invention shows one arrangement of melt pipelines and spinning units for a device composed of one liquid tackifying reactor and four spinning units.

The spinning units and the liquid tackifying reactors may be arranged into a "linear" pattern as shown in FIG. 2, into an "asteroidal" pattern as FIG. 3, or into a "symmetrically rectangular" pattern as shown in FIG. 4. In any of these cases, preferable results can be achieved.

The following manufacturing examples are provided for further describing the disclosed manufacturing device and the disclosed manufacturing method.

Manufacturing Embodiment 1

A polymerization device having annual capacity of 50,000 tons is selected to work with two liquid tackifying reactors. Each said liquid tackifying reactor corresponds to two spinning units. Each said spinning unit corresponds to 2-4 spinning positions. The arrangement between the liquid tackifying reactor and the spinning units as well as the design of the melt pipelines are shown in FIG. 3. The specific technical parameters used include:

(1) Liquid Tackifying:

Low-viscosity polyester melt with intrinsic viscosity of 0.63~0.68 dl/g is prepared using melt polycondensation and then pressurized by a booster pump and filtered by a filter before transported to tops of the vertical liquid tackifying reactors. The melt in the vertical liquid tackifying reactor falls naturally as an even film by gravity. Such a liquid tackifying process is conducted under temperature of 270~285° C. and pressure of 50~130 Pa for 40~90 minutes. After tackified, the melt has its intrinsic viscosity reaching 0.90~1.1 dL/g, with melt hue (b value) smaller than 4 and terminal carboxyl group content smaller than 30 mol/t.

(2) Transportation of High-Viscosity Melt

During melt transportation, the length of transportation through the pipeline between the discharge gate of the liquid tackifying reactor and each said spinning box is identical and not exceeding 15 m. Such pipeline is conducted using pipes having diameter of 25~100 mm, with temperature of 280~298° C., pressure of 25~30 MPa, and shear rate of 10~18 m/s, for retention time not exceeding 8.0 min, so as to control viscosity drop within 0.10 dL/g. The layout of the melt pipelines is as shown in FIG. 2.

(3) Multi-Head Spinning

For the arrangement where one liquid tackifying reactor works for two spinning units, each said spinning unit may have 2-4 spinning positions. 16-24 heads of spinning may be achieved at each said spinning position. The total denier count at a spinning position is up to 20040 dtex. The high-viscosity polyester melt after the liquid tackifying process is transported to the spinning boxes at all the spinning positions and held at 290~300° C. in the spinning boxes. The melt is then measured by a metering pump and filtered and comes out from the spinneret before quenched in the annealing area, clustered and oiled. For the metering pump, the pre- and post-pump pressures are 5~8 MPa and 15~20 MPa, respectively. The fineness of the filter is 15~20 μm. In the annealing area, the temperature is 310~350° C. For quenching, the air velocity is 0.3~0.6 m/s, with temperature of 60~80° C. and moisture of 70%~80%. Oiling is performed at a site 30~100 mm below the spinning chimney using two oil nozzles that draw oil form 2 oil pumps simultaneously. The oil pump is 0.05~0.10 CC and has 1 oil inlet and 16 oil outlets, with oil pick-up percentage of 0.4~1.05%.

(4) Drawing and Heat Setting:

This step is performed using a heat setting process including two stages of drawing and one stage of relaxation. The first pair of spinning rollers runs at 400~600 m/min, with total draw ratio of 5.6~6.2%.

(5) Winding Formation:

The set fiber is input into an interlacing process for winding formation. Therein, the interlacer pressure is 0.3~0.4 Mpa. Winding is achieved using a twin-type take-up machine, with winding speed of 2600~3300 m/min, winding tension of 170~230 cN, winding angle of 6.5°~7.5°.

Manufacturing Embodiment 2

A polymerization device having annual capacity of 100,000 tons is selected to work with three liquid tackifying reactors. Each said liquid tackifying reactor corresponds to two spinning units. Each said spinning unit corresponds to 2-4 spinning positions. The arrangement between the liquid tackifying reactor and the spinning units as well as the design of the melt pipelines are shown in FIG. 4. The specific technical parameters used include:

(1) Liquid Tackifying:

Low-viscosity polyester melt with intrinsic viscosity of 0.63~0.68 dl/g is prepared using melt polycondensation and then pressurized by a booster pump and filtered by a filter before transported to tops of the vertical liquid tackifying reactors. The melt in the vertical liquid tackifying reactor falls naturally as an even film by gravity. Such a liquid tackifying process is conducted under temperature of 270~285° C. and pressure of 50~130 Pa for 40~90 minutes. After tackified, the melt has its intrinsic viscosity reaching 0.90~1.1 dL/g, with melt hue (b value) smaller than 4 and terminal carboxyl group content smaller than 30 mol/t.

(2) Transportation of High-Viscosity Melt

During melt transportation, the length of transportation through the pipeline between the discharge gate of the liquid tackifying reactor and each said spinning box is identical and not exceeding 15 m. Such pipeline is conducted using pipes having diameter of 25~100 mm, with temperature of 280~298° C., pressure of 25~30 MPa, and shear rate of 10~18 m/s, for retention time not exceeding 4.6~7.0 min, so as to control viscosity drop within 0.10 dL/g. The layout of the melt pipelines is as shown in FIG. 3.

(3) Multi-Head Spinning

For the arrangement where one liquid tackifying reactor works for two spinning units, each said spinning unit may have 2-4 spinning positions. 16-24 heads of spinning may be achieved at each said spinning position. The total denier count at a spinning position is up to 20040 dtex. The high-viscosity polyester melt after the liquid tackifying process is transported to the spinning boxes at all the spinning positions and held at 290~300° C. in the spinning boxes. The melt is then measured by a metering pump and filtered and comes out from the spinneret before quenched in the annealing area, clustered and oiled. For the metering pump, the pre- and post-pump pressures are 5~8 MPa and 15~20 MPa, respectively. The fineness of the filter is 15~20 μm. In the annealing area, the temperature is 310~350° C. For quenching, the air velocity is 0.3~0.6 m/s, with temperature of 60~80° C. and moisture of 70%~80%. Oiling is performed at a site 30~100 mm below the spinning chimney using two oil nozzles that draw oil form 2 oil pumps simultaneously. The oil pump is 0.05~0.10 CC and has 1 oil inlet and 16 oil outlets, with oil pick-up percentage of 0.4~1.05%.

(4) Drawing and Heat Setting:

This step is performed using a heat setting process including two stages of drawing and one stage of relaxation. The first pair of spinning rollers runs at 400~600 m/min, with total draw ratio of 5.6~6.2%.

(5) Winding Formation:

The set fiber is input into an interlacing process for winding formation. Therein, the interlacer pressure is 0.3~0.4 Mpa. Winding is achieved using a twin-type take-up machine, with winding speed of 2600~3300 m/min, winding tension of 170~230 cN, winding angle of 6.5°~7.5°.

Manufacturing Embodiment 3

A polymerization device having annual capacity of 200,000 tons is selected to work with four liquid tackifying reactors. Each said liquid tackifying reactor corresponds to two spinning units. Each said spinning unit corresponds to 2-4 spinning positions. The arrangement between the liquid tackifying reactor and the spinning units as well as the design of the melt pipelines are shown in FIG. 5. The specific technical parameters used include:

(1) Liquid Tackifying:

Low-viscosity polyester melt with intrinsic viscosity of 0.63~0.68 dl/g is prepared using melt polycondensation and then pressurized by a booster pump and filtered by a filter before transported to tops of the vertical liquid tackifying reactors. The melt in the vertical liquid tackifying reactor falls naturally as an even film by gravity. Such a liquid tackifying process is conducted under temperature of 270~285° C. and pressure of 50~130 Pa for 40~90 minutes. After tackified, the melt has its intrinsic viscosity reaching 0.90~1.1 dL/g, with melt hue (b value) smaller than 4 and terminal carboxyl group content smaller than 30 mol/t.

(2) Transportation of High-Viscosity Melt

During melt transportation, the length of transportation through the pipeline between the discharge gate of the liquid tackifying reactor and each said spinning box is identical and not exceeding 15 m. Such pipeline is conducted using pipes having diameter of 25~100 mm, with temperature of 280~298° C., pressure of 25~30 MPa, and shear rate of 10~18 m/s, for retention time not exceeding 4.6~7.0 min, so as to control viscosity drop within 0.10 dL/g. The layout of the melt pipelines is as shown in FIG. 4.

(3) Multi-Head Spinning

For the arrangement where one liquid tackifying reactor works for two spinning units, each said spinning unit may have 2-4 spinning positions. 16-24 heads of spinning may be achieved at each said spinning position. The total denier count at a spinning position is up to 20040 dtex. The high-viscosity polyester melt after the liquid tackifying process is transported to the spinning boxes at all the spinning positions and held at 290~300° C. in the spinning boxes. The melt is then measured by a metering pump and filtered and comes out from the spinneret before quenched in the annealing area, clustered and oiled. For the metering pump, the pre- and post-pump pressures are 5~8 MPa and 15~20 MPa, respectively. The fineness of the filter is 15~20 μm. In the annealing area, the temperature is 310~350° C. For quenching, the air velocity is 0.3~0.6 m/s, with temperature of 60~80° C. and moisture of 70%~80%. Oiling is performed at a site 30~100 mm below the spinning chimney using two oil nozzles that draw oil form 2 oil pumps simultaneously. The oil pump is 0.05~0.10 CC and has 1 oil inlet and 16 oil outlets, with oil pick-up percentage of 0.4~1.05%.

(4) Drawing and Heat Setting:

This step is performed using a heat setting process including two stages of drawing and one stage of relaxation. The first pair of spinning rollers runs at 400~600 m/min, with total draw ratio of 5.6~6.2%.

(5) Winding Formation:

The set fiber is input into an interlacing process for winding formation. Therein, the interlacer pressure is 0.3~0.4 Mpa. Winding is achieved using a twin-type take-up machine, with winding speed of 2600~3300 m/min, winding tension of 170~230 cN, winding angle of 6.5°~7.5°.

What is claimed is:

1. A polyethylene terephthalate (PET) industrial yarn melt direct spinning manufacturing device, comprising:

a polymerizer using a high-capacity continuous polymerizing apparatus and used for preparing base polyester melt that is polyethylene terephthalate (PET) melt having intrinsic viscosity of 0.63~0.68 dL/g;

2 to 10 liquid tackifying reactors each connected with the high-capacity continuous polymerizing apparatus through a split-flow pipeline, wherein the base polyester melt after tackified by the liquid tackifying reactor has the intrinsic viscosity reaching 0.90~1.10 dL/g;

multi-head spinning units in a number ranging between 2 and 10 connected with each said liquid tackifying reactor, wherein each of the spinning units is connected with the corresponding liquid tackifying reactor through a melt pipeline and equipped with 2 to 4 spinning boxes;

wherein each set of said spinning units are located below one of said liquid tackifying reactors and evenly distributed to center around said one of said liquid tackifying reactors.

2. The PET industrial yarn melt direct spinning manufacturing device of claim 1, wherein the liquid tackifying reactor is a vertical reactor having a capacity of 30 to 120 ton/day.

3. The PET industrial yarn melt direct spinning manufacturing device of claim 1, wherein the spinning units are evenly distributed around a discharge gate of the liquid tackifying reactor, and all the melt pipelines between the spinning boxes and the discharge gate of the liquid tackifying reactor have an identical length of transportation.

4. The PET industrial yarn melt direct spinning manufacturing device of claim 1, wherein the melt pipeline between the spinning unit and a discharge gate of the liquid tackifying reactor has a length of transportation not exceeding 15 m and has a diameter of 25~100 mm.

5. The PET industrial yarn melt direct spinning manufacturing device of claim 1, wherein the spinning units and the liquid tackifying reactor are arranged into a "linear", "asteroidal" or "symmetrically rectangular" pattern.

6. A polyethylene terephthalate (PET) industrial yarn melt direct spinning manufacturing method, comprising the following steps:

(1) preparing base polyester melt: performing esterification and melt polycondensation on terephthalic acid and ethylene glycol in a high-capacity continuous polymerizing apparatus, so as to produce PET base polyester melt having intrinsic viscosity of 0.63~0.68 dL/g, wherein parameters used include:

molar ratio between ethylene glycol and terephthalic acid of 1~1.3; for esterification, temperature of 250~265° C., pressure of 0.12~0.18 Mpa, and time 3~5 hours; for pre-polycondensation, temperature of 265~275° C., pressure of 2500~3000 Pa, and time of 1~1.5 hours; and for polycondensation, temperature of 275~295° C., pressure of 50~150 Pa, and time of 1.5~2.5 hours;

(2) liquid tackifying: transporting the prepared base polyester melt to liquid tackifying reactors through split-flow pipelines respectively for polycondensation, so as to produce high-viscosity polyester melt having intrinsic viscosity of 0.90~1.10 dL/g, wherein:

the liquid tackifying reactor is a vertical reactor, and parameters used for liquid tackifying include: temperature of 270~285° C., pressure of 50~130 Pa, time of 40~90 min, so that the tackified intrinsic viscosity reaches 0.90~1.1 dL/g, melt hue (b value) smaller than 4, and terminal carboxyl group content smaller than 30 mol/t;

(3) multi-head spinning: transporting the tackified high viscosity polyester melt to the spinning units through the melt pipelines respectively for multi-head spinning that is intensive spinning with 16~24 heads, wherein:

for transporting the high-viscosity polyester melt to each said spinning unit through each said melt pipeline, parameters used include: length of transportation not exceeding 15 m, diameter of 25~100 mm, pipeline temperature of 280~298° C., pressure of 25~30 MPa, shear rate of 10~18 m/s, retention time of 4.6~7.0 min, and viscosity drop within 0.10 dL/g;

submitting the high viscosity polyester melt to a process of metering using a metering pump, filtering, spinning at spinnerets, quenching through chimneys, clustering and oiling, drawing and setting, and interlacing and winding formation, thereby completing spinning;

wherein each set of said spinning units are located below one of said liquid tackifying reactors and evenly distributed to center around said one of said liquid tackifying reactors.

7. The PET industrial yarn melt direct spinning manufacturing method of claim 6, wherein each said spinning unit has 2 spinning boxes, and each said spinning box has 4~6 spinning members, wherein each said spinning member spins two strands of yarn, so that there are 16~24 heads at each spinning position and a total denier count at a single said spinning position reaches 20040 dtex, with spinning temperature of 290~305° C., total draw ratio of 5.6~6.2%, and oil pick-up percentage of 0.4~1.05%.

8. The PET industrial yarn melt direct spinning manufacturing method of claim 6, wherein each said spinning member spins two strands of yarn, and each said spinning member is of a twin-cavity cup type and has two melt passages, wherein two melting cavities of the spinning member each have an independent melt-filter, and two streams of the melt for the two heads share a common spinneret that has a split structure.

9. The PET industrial yarn melt direct spinning manufacturing method of claim 6, wherein said winding is performed using a parallel twin take-up machine running with winding speed of 2600~3300 m/min.

* * * * *